US011512459B2

(12) United States Patent
Bohlen et al.

(10) Patent No.: US 11,512,459 B2
(45) Date of Patent: Nov. 29, 2022

(54) DISPOSAL SPLASH GUARD

(71) Applicant: FB Global Plumbing Group LLC, North Olmsted, OH (US)

(72) Inventors: John R. Bohlen, Solon, OH (US); Russell A. Ferqueron, North Olmsted, OH (US); Kevin A. Lumby, Olmsted Township, OH (US); Christopher W. McDonald, Garfield Heights, OH (US); Christian R. Rasmussen, Olmsted Falls, OH (US)

(73) Assignee: Fortune Brands Water Innovations LLC, North Olmsted, OH (US)

( * ) Notice: Subject to any disclaimer, the term of this patent is extended or adjusted under 35 U.S.C. 154(b) by 0 days.

(21) Appl. No.: 17/341,545

(22) Filed: Jun. 8, 2021

(65) Prior Publication Data

US 2021/0381212 A1 Dec. 9, 2021

Related U.S. Application Data

(60) Provisional application No. 63/036,668, filed on Jun. 9, 2020.

(51) Int. Cl.
*E03C 1/181* (2019.01)
*E03C 1/266* (2006.01)

(52) U.S. Cl.
CPC ..... *E03C 1/181* (2013.01); *E03C 1/2665* (2013.01)

(58) Field of Classification Search
CPC ..... E03C 1/181; E03C 1/2665
USPC ..... 4/658; 241/46.013
See application file for complete search history.

(56) References Cited

U.S. PATENT DOCUMENTS 3,012,422 A * 12/1961 Zimmerer ..... F16D 9/06 241/46.11
3,423,036 A * 1/1969 Stewart ..... E03C 1/2665 241/46.016
3,524,596 A * 8/1970 Smith ..... F16K 21/04 241/46.016
3,641,231 A * 2/1972 Smith ..... B29C 69/001 264/155

(Continued)

OTHER PUBLICATIONS

Author unknown, K-Guard Leaf Free Gutter System Marketing Materials, the product shown in the Marketing Materials is believed to have been publicly available prior to Jun. 9, 2020 (10 pages).

*Primary Examiner* — Benjamin R Shaw
(74) *Attorney, Agent, or Firm* — Calfee, Halter & Griswold LLP

(57) ABSTRACT

The present invention provides a disposal splash guard that enables water flowing into the disposal splash guard to be directed through peripheral openings in the disposal splash guard. The disposal splash guard comprises a body and a baffle. A size of the peripheral openings is operable to direct water flowing into the disposal splash guard through the peripheral openings in the baffle. At least one of a shape of the body and a shape of the baffle is operable to direct water flowing into the disposal splash guard through the peripheral openings in the baffle. At least one of a size of the peripheral openings, a shape of the body, and a shape of the baffle is operable to direct at least ten percent of water flowing into the disposal splash guard through the peripheral openings in the baffle.

20 Claims, 6 Drawing Sheets

(56) References Cited

U.S. PATENT DOCUMENTS

| | | | | |
|---|---|---|---|---|
| 3,693,892 | A * | 9/1972 | Musa | E03C 1/2665 241/46.016 |
| 5,249,749 | A | 10/1993 | Krebsbach | |
| 6,735,791 | B1 * | 5/2004 | Lordahl | E03C 1/262 4/286 |
| 7,533,836 | B2 | 5/2009 | Pan | |
| 8,220,731 | B2 * | 7/2012 | Berger | E03C 1/266 241/46.013 |
| 8,856,977 | B2 | 10/2014 | Ramirez | |
| 10,398,886 | B2 | 9/2019 | Myers | |
| 2002/0063179 | A1 * | 5/2002 | Farmerie | E03C 1/2665 241/46.013 |
| 2002/0104908 | A1 * | 8/2002 | Berger | E03C 1/2665 241/21 |
| 2003/0066914 | A1 * | 4/2003 | Jara-Almonte | E03C 1/2665 241/46.013 |
| 2004/0256506 | A1 * | 12/2004 | Berger | E03C 1/2665 241/46.013 |
| 2006/0202069 | A1 | 9/2006 | Chavez | |
| 2019/0082820 | A1 | 3/2019 | Schuster et al. | |
| 2021/0164208 | A1 * | 6/2021 | McClory | E03C 1/2665 |

* cited by examiner

DISPOSAL SPLASH GUARD

CROSS-REFERENCE TO RELATED APPLICATION

This application claims the benefit of U.S. Provisional Application No. 63/036,668, filed Jun. 9, 2020, the entire disclosure of which is hereby incorporated by reference.

FIELD

The present invention relates generally to a disposal splash guard and, more particularly, to a disposal splash guard that enables water flowing into the disposal splash guard to be directed through peripheral openings in the disposal splash guard.

BACKGROUND

Disposal splash guards prevent water and food waste from being ejected out of a disposal during use. Disposal splash guards include a central opening. Typical disposal splash guards direct water flowing into the disposal splash guard through the central opening in the disposal splash guard. As a result, food waste can accumulate in the disposal. A mechanism that reduces food waste accumulating in the disposal is desired.

SUMMARY

The present invention provides a disposal splash guard that enables water flowing into the disposal splash guard to be directed through peripheral openings in the disposal splash guard.

In an exemplary embodiment, the disposal splash guard comprises a body and a baffle. The body is generally cylindrical shaped. The body includes an inner surface and an outer surface. The baffle extends inwardly from the inner surface of the body. The baffle includes an upper surface and a lower surface. The baffle includes a primary opening and a plurality of peripheral openings extending from the upper surface through the lower surface. The baffle includes a plurality of splits and a plurality of flaps. A size of the peripheral openings is operable to direct water flowing into the disposal splash guard through the peripheral openings in the baffle.

In an exemplary embodiment, the disposal splash guard comprises a body and a baffle. The body is generally cylindrical shaped. The body includes an inner surface and an outer surface. The baffle extends inwardly from the inner surface of the body. The baffle includes an upper surface and a lower surface. The baffle includes a primary opening and a plurality of peripheral openings extending from the upper surface through the lower surface. The baffle includes a plurality of splits and a plurality of flaps. At least one of a shape of the body and a shape of the baffle is operable to direct water flowing into the disposal splash guard through the peripheral openings in the baffle.

In an exemplary embodiment, the disposal splash guard comprises a body and a baffle. The body is generally cylindrical shaped. The body includes an inner surface and an outer surface. The baffle extends inwardly from the inner surface of the body. The baffle includes an upper surface and a lower surface. The baffle includes a primary opening and a plurality of peripheral openings extending from the upper surface through the lower surface. The baffle includes a plurality of splits and a plurality of flaps. At least one of a size of the peripheral openings, a shape of the body, and a shape of the baffle is operable to direct at least ten percent of water flowing into the disposal splash guard through the peripheral openings in the baffle.

BRIEF DESCRIPTION OF THE DRAWINGS

—FIG. 2*a* is a perspective view, FIG. 2*b* is a top plan view, FIG. 2*c* is a cross-sectional view taken along the line 2*c*-2*c* in FIG. 2*b*, and FIG. 2*d* is a cross-sectional view taken along the line 2*d*-2*d* in FIG. 2*b;*

—FIG. 3*a* is a perspective view, FIG. 3*b* is a top plan view, FIG. 3*c* is a cross-sectional view taken along the line 3*c*-3*c* in FIG. 3*b*, FIG. 3*d* is a cross-sectional view taken along the line 3*d*-3*d* in FIG. 3*b*, and FIG. 3*e* is a detailed view of the section 3*e* in FIG. 3*c;*

—FIG. 4*a* is a perspective view, FIG. 4*b* is a top plan view, FIG. 4*c* is a cross-sectional view taken along the line 4*c*-4*c* in FIG. 4*b*, and FIG. 4*d* is a detailed view of the section 4*d* in FIG. 4*c;*

—FIG. 5*a* is an exploded perspective view, FIG. 5*b* is a top plan view, FIG. 5*c* is a side elevational view, and FIG. 5*d* is a cross-sectional view taken along the line 5*d*-5*d* in FIG. 5*b*; —FIG. 6*a* is a top plan view showing peripheral openings, FIG. 6*b* is a top plan view showing an imaginary outer line and an imaginary inner line extending through a radially outer side and a radially inner side, respectively, of a lower edge of the peripheral openings, FIG. 6*c* is a top plan view showing an imaginary center line extending through radial center points of the peripheral openings, and FIG. 6*d* is a top plan view showing a first imaginary radial line and a second imaginary radial line extending through a first circumferential end and a second circumferential end, respectively, of the lower edge of the peripheral openings.

DETAILED DESCRIPTION

The present invention provides a disposal splash guard. In exemplary embodiments, the disposal splash guard enables water flowing into the disposal splash guard to be directed through peripheral openings in the disposal splash guard.

Figure 1:
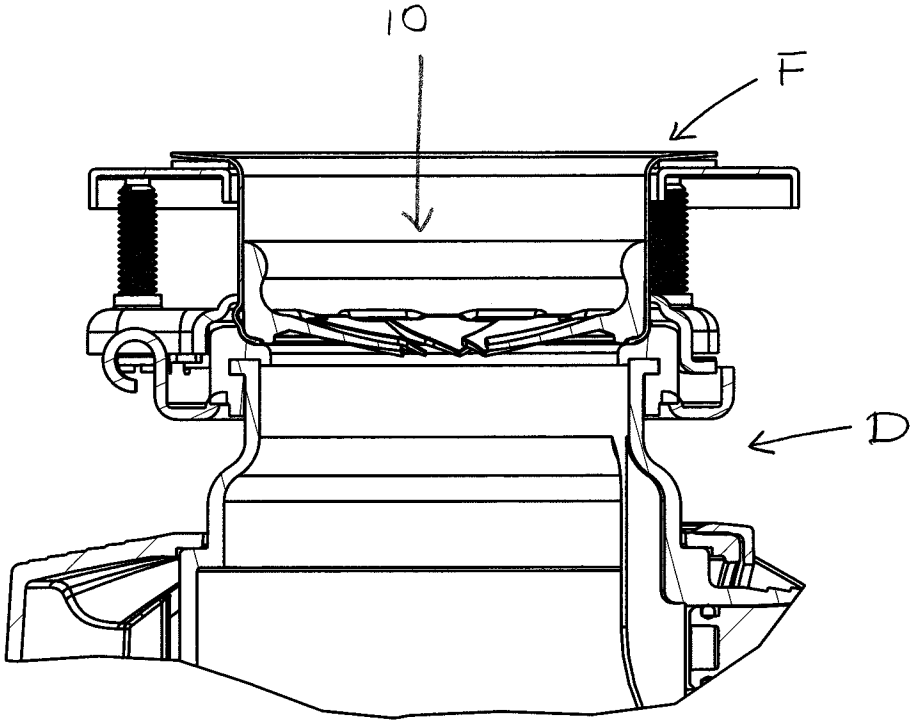
FIG. 1 is a cross-sectional view of a disposal splash guard according to a first exemplary embodiment of the present invention installed in a mounting flange of a disposal.
Figure 2A:
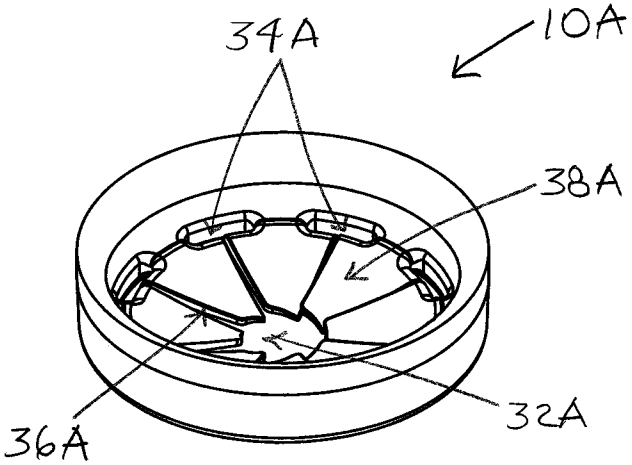
FIGS. 2*a*-2*d* are views of the disposal splash guard of FIG. 1
Figure 2D:
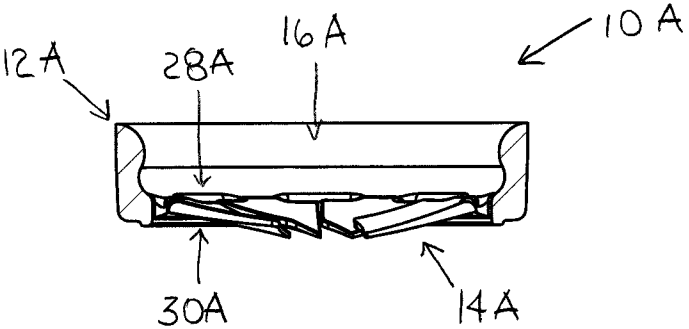
Figure 2B:
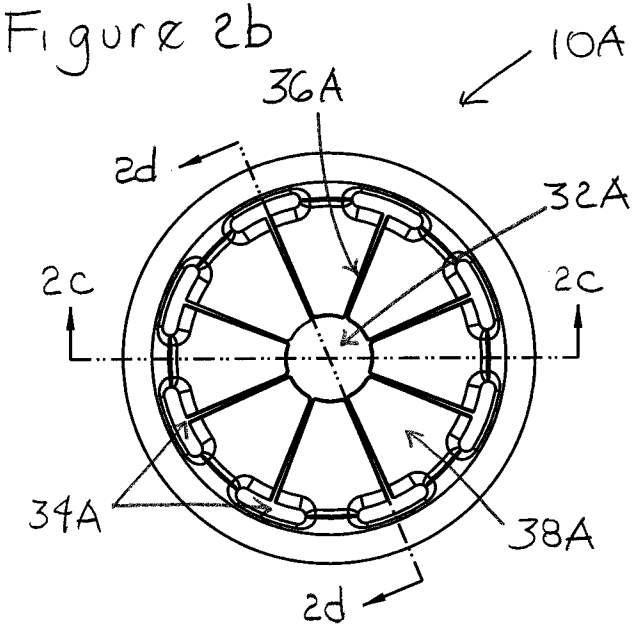
Figure 2C:
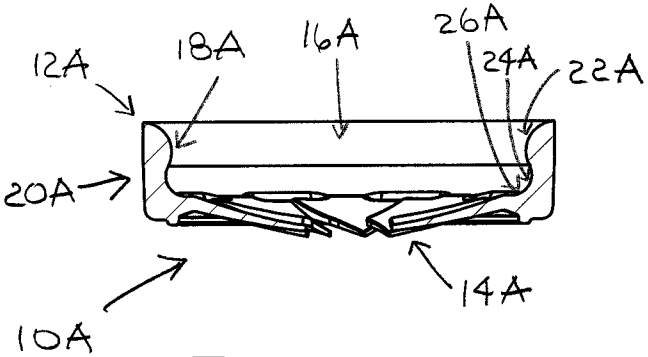
Figure 3A:
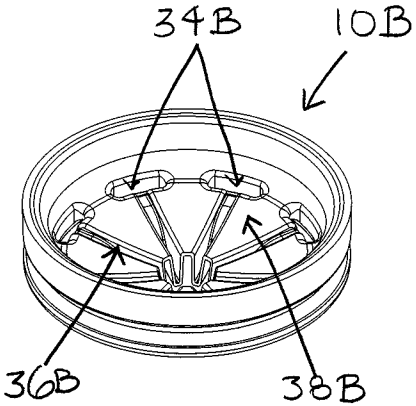
FIGS. 3*a*-3*e* are views of a disposal splash guard according to a second exemplary embodiment of the present invention
Figure 3D:
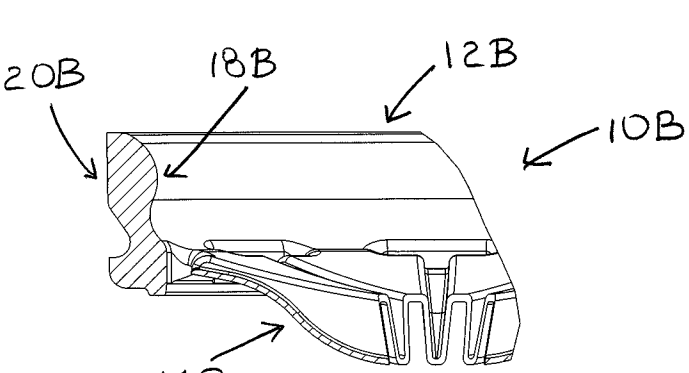
Figure 3E:
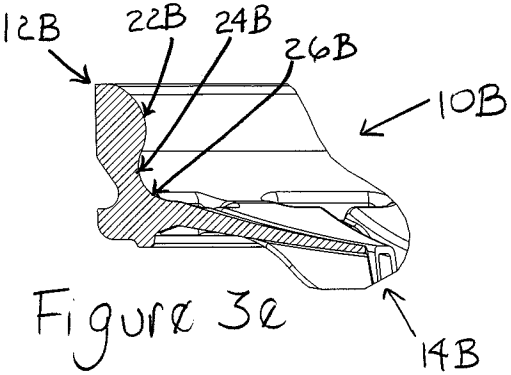
Figure 3B:
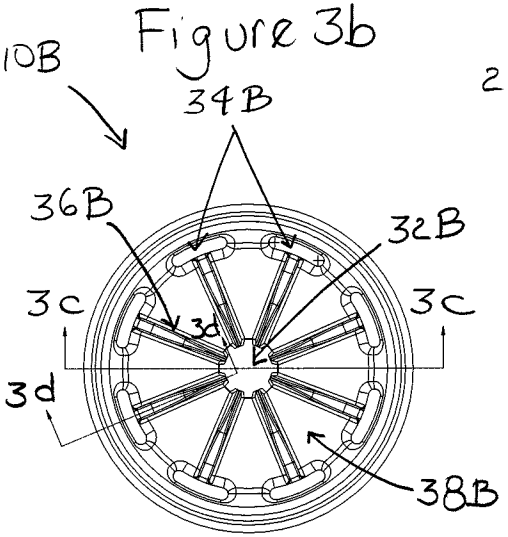
Figure 3C:
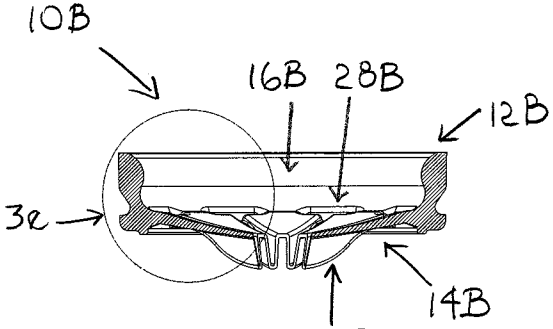
Figure 4A:
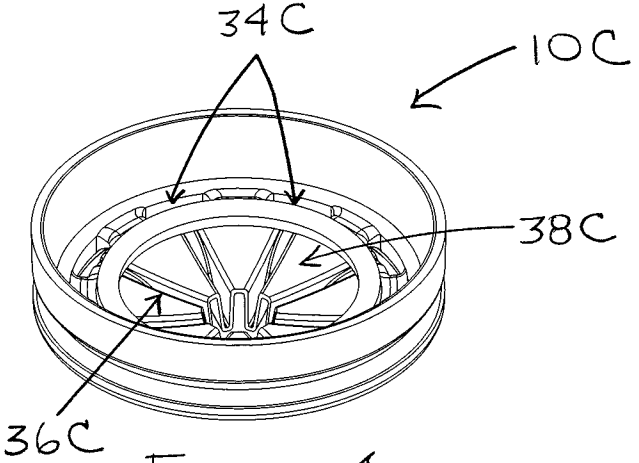
FIGS. 4*a*-4*d* are views of a disposal splash guard according to a third exemplary embodiment of the present invention
Figure 4B:
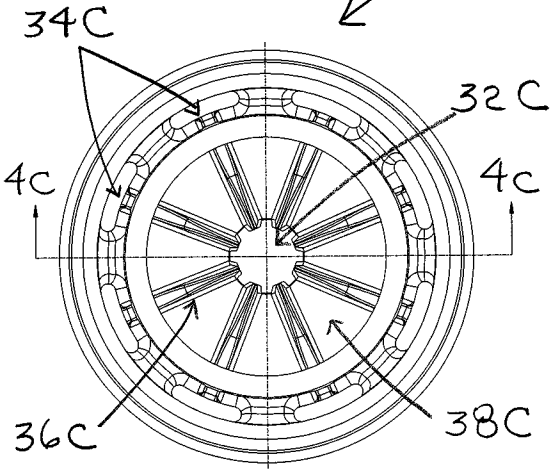
Figure 4D:
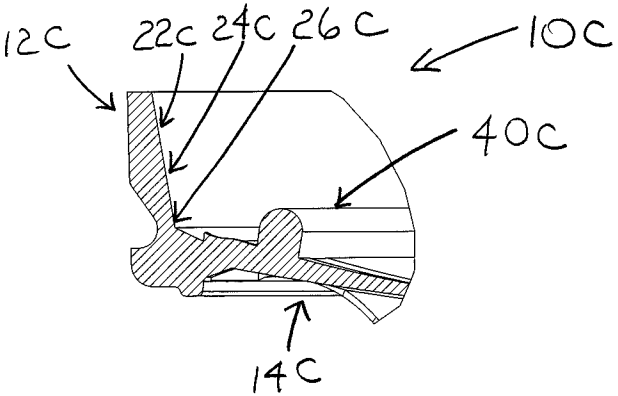
Figure 4C:
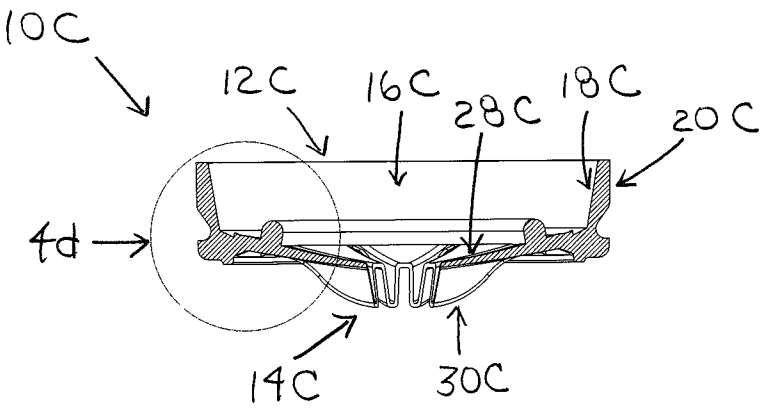
Figure 5D:
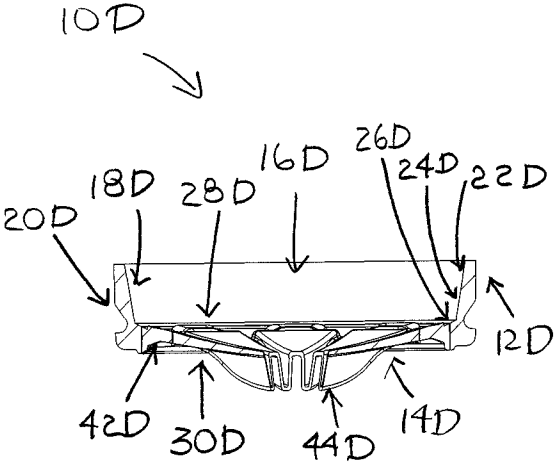
FIGS. 5*a*-5*d* are views of a disposal splash guard according to a fourth exemplary embodiment of the present invention
Figure 5C:
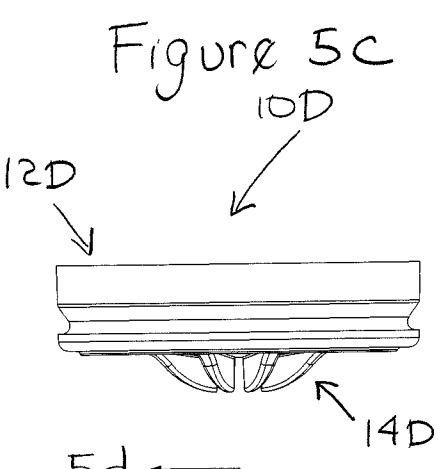
Figure 5B:
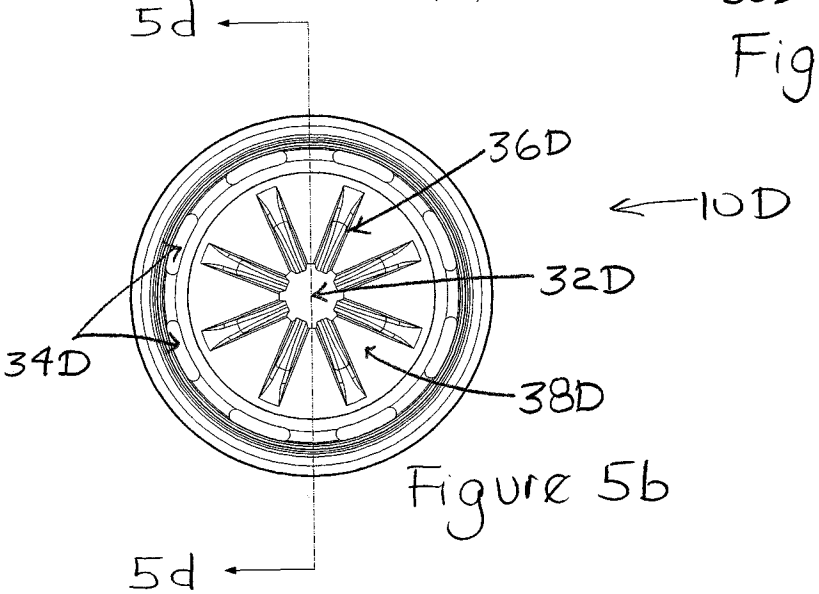
Figure 5A:
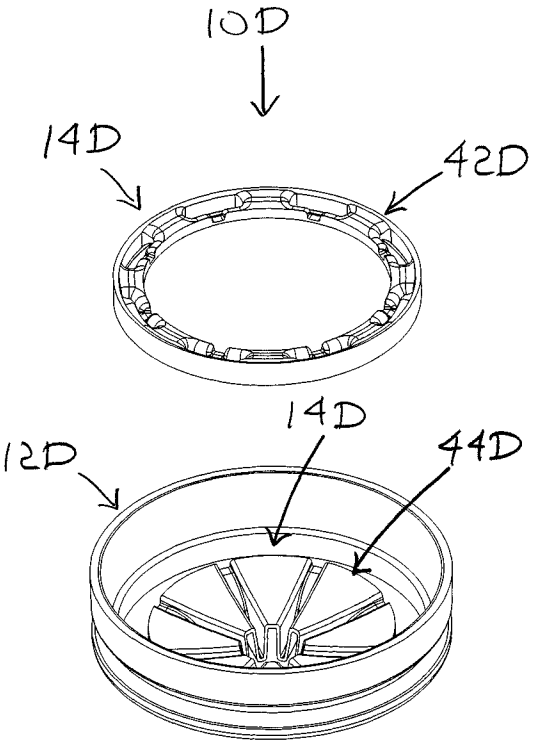

As illustrated in FIG. 1, a disposal splash guard 10 is operable to be installed in a mounting flange F of a disposal D.

Exemplary embodiments of the disposal splash guard 10 of the present invention are shown in detail in FIGS. 2*a*-2*d*, 3*a*-3*e*, 4*a*-4*d*, and 5*a*-5*d*. The same reference numbers in combination with different letters (i.e., letters A, B, C, and D) will be used to identify the different embodiments (i.e., the embodiments as shown in FIGS. 2*a*-2*d*, 3*a*-3*e*, 4*a*-4*d*, and 5*a*-5*d*). A reference number alone will be used to generically identify all embodiments (i.e., embodiments A, B, C, and D as shown in FIGS. 2*a*-2*d*, 3*a*-3*e*, 4*a*-4*d*, and 5*a*-5*d*, respectively).

In exemplary embodiments, the disposal splash guard 10 includes a body 12 and a baffle 14.

In exemplary embodiments, the body 12 is generally cylindrical shaped. In exemplary embodiments, the body 12 includes an opening 16. In exemplary embodiments, the opening 16 is a generally central opening. In exemplary embodiments, the body 12 includes an inner surface 18 and an outer surface 20. In exemplary embodiments, the inner surface 18 includes an upper portion 22, a middle portion 24, and a lower portion 26. In exemplary embodiments, the upper portion 22 of the inner surface 18 of the body 12 is generally convex shaped. In exemplary embodiments, the middle portion 24 of the inner surface 18 of the body 12 is generally concave shaped. In exemplary embodiments, the upper portion 22 and the middle portion 24 of the inner surface 18 of the body 12 are generally straight. In exemplary embodiments, the inner surface 18 of the body 12 generally angles inwardly from the upper portion 22 to the middle portion 24.

In exemplary embodiments, the baffle 14 extends inwardly from the lower portion 26 of the inner surface 18 of the body 12 across the opening 16 in the body 12. However, one of ordinary skill in the art will appreciate that the baffle 14 could extend inwardly from any portion of the inner surface 18 of the body 12. In exemplary embodiments, the baffle 14 includes an upper surface 28 and a lower surface 30. In exemplary embodiments, the baffle 14 includes a primary opening 32. In exemplary embodiments, the primary opening 32 extends from the upper surface 28 through the lower surface 30 of the baffle 14. In exemplary embodiments, the primary opening 32 is a generally central opening.

In exemplary embodiments, the baffle 14 includes a plurality of peripheral openings 34. In exemplary embodiments, the peripheral openings 34 extend from the upper surface 28 through the lower surface 30 of the baffle 14. In exemplary embodiments, the peripheral openings 34 are generally spaced around a circumference of the baffle 14. In exemplary embodiments, the peripheral openings 34 are generally funnel shaped. In exemplary embodiments, the peripheral openings 34 are generally oblong shaped in a circumferential direction.

In exemplary embodiments, the baffle 14 includes a plurality of splits 36. In exemplary embodiments, the splits 36 extend between the primary opening 32 and at least one of the peripheral openings 34 in a radial direction. In exemplary embodiments, the baffle 14 includes a plurality of flaps 38. In exemplary embodiments, the flaps 38 extend between the primary opening 32 and the peripheral openings 34 in a radial direction and between the splits 36 in a circumferential direction. In exemplary embodiments, the splits 36 are slits (i.e., there is a break in the material of the baffle 14 between the flaps 38 that enables the flaps 38 to flex). In exemplary embodiments, the splits 36 are webs (i.e., there is no break in the material of the baffle 14 between the flaps 38, but there is additional material that enables the flaps 38 to flex).

In exemplary embodiments, the baffle 14 includes a ridge 40. In exemplary embodiments, the ridge 40 extends in a circumferential direction radially inward of the peripheral openings 34. In exemplary embodiments, the ridge 40 is continuous. In exemplary embodiments, the ridge 40 is non-continuous. In exemplary embodiments in which the ridge 40 is non-continuous, the ridge 40 generally extends along radial outer edges of the splits 36, but generally does not extend along radial outer edges of the flaps 38.

In exemplary embodiments, the baffle 14 includes a first portion 42 and a second portion 44. In exemplary embodiments, the first portion 42 includes the plurality of peripheral openings 34. In exemplary embodiments, the second portion 44 includes the primary opening 32, the plurality of splits 36, and the plurality of flaps 38. In exemplary embodiments, the first portion 42 and the second portion 44 are made from different materials. In exemplary embodiments, the first portion 42 is made from a harder material than the second portion 44.

Figures 6A, 6B, 6C, 6D:
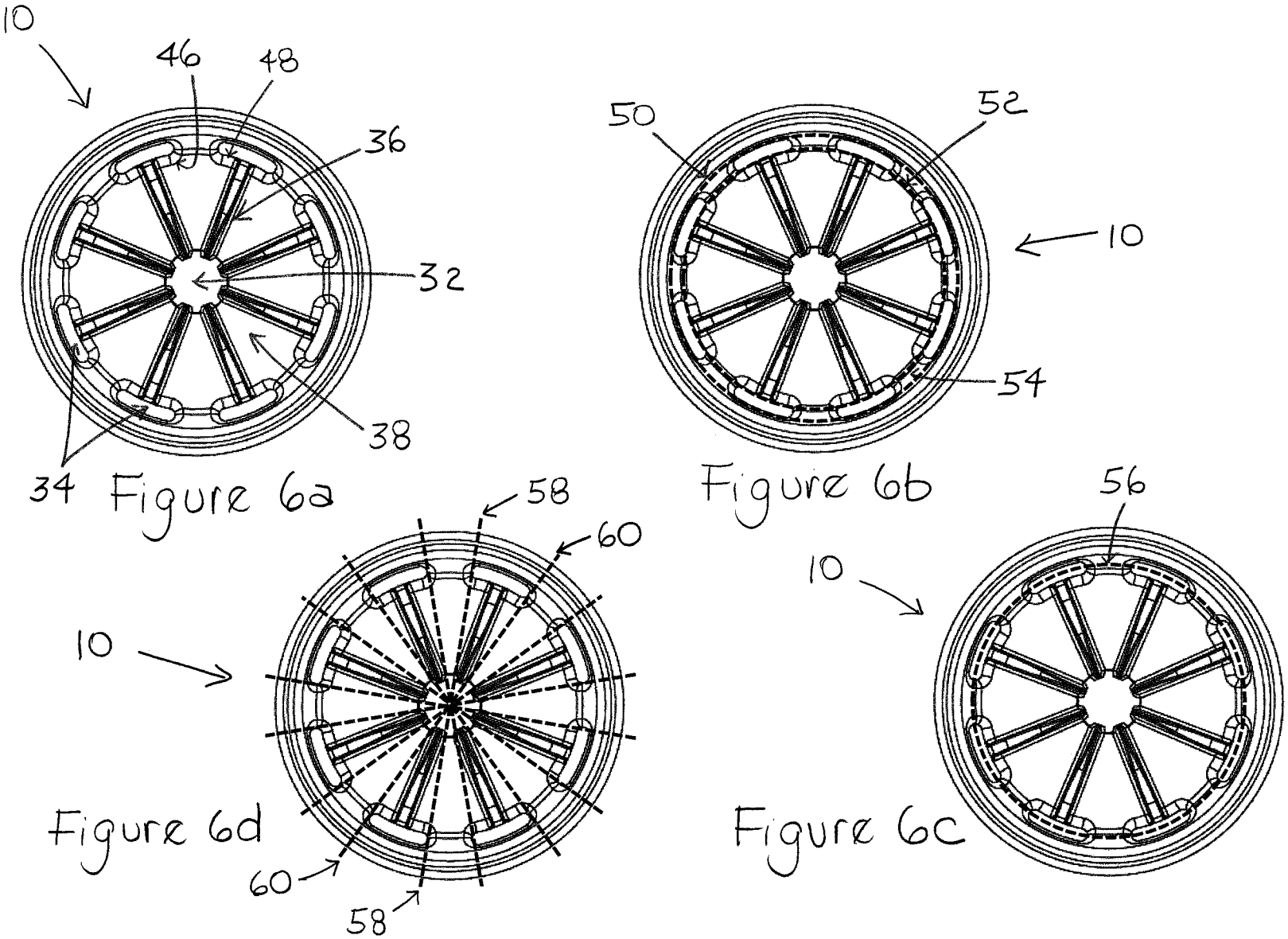
FIGS. 6*a*-6*d* are views of a disposal splash guard according to exemplary embodiments of the present invention

In exemplary embodiments, as best shown in FIG. 6*a*, each peripheral opening 34 includes an upper edge 46 through the upper surface 28 of the baffle 14 and a lower edge 48 through the lower surface 30 of the baffle 14. In exemplary embodiments, each peripheral opening 34 includes a radially outer side of the upper edge 46 and a radially inner side of the upper edge 46. In exemplary embodiments, each peripheral opening 34 includes a radially outer side of the lower edge 48 and a radially inner side of the lower edge 48. In exemplary embodiments, each peripheral opening 34 includes a first circumferential end of the upper edge 46 and a second circumferential end of the upper edge 46. In exemplary embodiments, each peripheral opening 34 includes a first circumferential end of the lower edge 48 and a second circumferential end of the lower edge 48.

In an exemplary embodiment, the disposal splash guard 10 has the following dimensions:

(1) an outer diameter of the body 12 is approximately 3.4 inches;

(2) an inner diameter of the convex shaped upper portion 22 of the inner surface 18 of the body 12 is approximately 2.9 inches;

(3) a diameter of the radially outer side of the upper edge 46 through the upper surface 28 of the baffle 14 is approximately 2.9 inches;

(4) a diameter of the radially outer side of the lower edge 48 through the lower surface 30 of the baffle 14 is approximately 2.8 inches;

(5) a diameter of the radially inner side of the lower edge 48 through the lower surface 30 of the baffle 14 is approximately 2.6 inches;

(6) a diameter of the radially inner side of the upper edge 46 through the upper surface 28 of the baffle 14 is approximately 2.375 inches;

(7) a distance between the first circumferential end of the upper edge 46 and the second circumferential end of the upper edge 46 is approximately 0.75 inches; and (8) a distance between the first circumferential end of the lower edge 48 and the second circumferential end of the lower edge 48 is approximately 0.6 inches.

In exemplary embodiments, as best shown in FIG. 6*b*, each peripheral opening 34 has a peripheral opening area. In exemplary embodiments, the peripheral opening area is an area of the peripheral opening 34 at the lower edge 48 through the lower surface 30 of the baffle 14. In exemplary embodiments, each baffle 14 has a total peripheral opening area. In exemplary embodiments, the total peripheral opening area is a sum of the peripheral opening area for all peripheral openings 34.

In exemplary embodiments, as best shown in FIG. 6*b*, the baffle 14 includes an imaginary outer line 50 extending through the radially outer side of the lower edge 48 of the peripheral openings 34 and an imaginary inner line 52 extending through the radially inner side of the lower edge 48 of the peripheral openings 34. In exemplary embodiments, the baffle 14 includes a peripheral opening ring 54 extending between the outer imaginary line and the inner imaginary line. In exemplary embodiments, the baffle 14 includes a peripheral opening ring area. In exemplary embodiments, the peripheral opening ring area is an area of the peripheral opening ring 54.

In exemplary embodiments, as best shown in FIG. 6*b*, the total peripheral opening area is greater than approximately twenty percent (20%) of the peripheral opening ring area. In exemplary embodiments, the total peripheral opening area is greater than approximately thirty percent (30%) of the peripheral opening ring area. In exemplary embodiments, the total peripheral opening area is greater than approximately forty percent (40%) of the peripheral opening ring area. In exemplary embodiments, the total peripheral opening area is greater than approximately fifty percent (50%) of the peripheral opening ring area. In an exemplary embodiment, the total peripheral opening area is approximately fifty-five percent (55%) of the peripheral opening ring area.

In exemplary embodiments, as best shown in FIG. 6*c*, each peripheral opening 34 has a peripheral opening length. In exemplary embodiments, the peripheral opening length is a length in a circumferential direction between the first circumferential end of the lower edge 48 of the peripheral opening 34 and the second circumferential end of the lower edge 48 of the peripheral opening 34. In exemplary embodiments, the baffle 14 has a total peripheral opening length. In exemplary embodiments, the total peripheral opening length is a sum of the peripheral opening length for all peripheral openings 34.

In exemplary embodiments, as best shown in FIG. 6*c*, each peripheral opening 34 includes a radial center point generally equidistant between the radially outer side of the lower edge 48 of the peripheral opening and the radially inner side of the lower edge 48 of the peripheral opening 34. In exemplary embodiments, the baffle 14 includes an imaginary center line 56 extending through the radial center points of the peripheral openings. In exemplary embodiments, the imaginary center line 56 has an imaginary center line length. In exemplary embodiments, the imaginary center line length is a length in a circumferential direction of the imaginary center line 56.

In exemplary embodiments, as best shown in FIG. 6*c*, the total peripheral opening length is greater than approximately twenty percent (20%) of the imaginary center line length. In exemplary embodiments, the total peripheral opening length is greater than approximately thirty percent (30%) of the imaginary center line length. In exemplary embodiments, the total peripheral opening length is greater than approximately forty percent (40%) of the imaginary center line length. In exemplary embodiments, the total peripheral opening length is greater than approximately fifty percent (50%) of the imaginary center line length. In an exemplary embodiment, the total peripheral opening length is approximately fifty-five percent (55%) of the imaginary center line length.

In exemplary embodiments, as best shown in FIG. 6*d*, the baffle 14 includes a first imaginary radial line 58 extending through the first circumferential end of the lower edge 48 of the peripheral opening 34 and a second imaginary radial line 60 extending through the second circumferential end of the lower edge 48 of the peripheral opening 34. In exemplary embodiments, each peripheral opening 34 has a peripheral opening angular distance. In exemplary embodiments, the peripheral opening angular distance is an angular distance between the first imaginary radial line 58 and the second imaginary radial line 60. In exemplary embodiments, the baffle 14 has a total peripheral opening angular distance. In exemplary embodiments, the total peripheral opening angular distance is a sum of the peripheral opening angular distance for all peripheral openings 34

In exemplary embodiments, as best shown in FIG. 6*d*, the total peripheral opening angular distance is greater than approximately seventy-five degrees (75°). In exemplary embodiments, the total peripheral opening angular distance is greater than approximately one-hundred ten degrees (110°). In exemplary embodiments, the total peripheral opening angular distance is greater than approximately one-hundred forty-five degrees (145°). In exemplary embodiments, the total peripheral opening angular distance is greater than approximately one-hundred eights degrees (180°). In an exemplary embodiment, the total peripheral opening angular distance is approximately two hundred degrees (200°).

In exemplary embodiments, at least one of a size of the peripheral openings 34, a shape of the body 12, and a shape of the baffle 14 is operable to direct water flowing into the disposal splash guard 10 through the peripheral openings 34 in the baffle 14. In exemplary embodiments, any combination of the size of the peripheral openings 34, the shape of the body 12, and the shape of the baffle 14 is operable to direct water flowing into the disposal splash guard 10 through the peripheral openings 34 in the baffle 14.

In exemplary embodiments, the size of the peripheral openings 34 in the baffle 14 includes:

(1) the total peripheral opening area is greater than approximately twenty percent (20%), thirty percent (30%), forty percent (40%), and fifty (50%) of the peripheral ring opening area;

(2) the total peripheral opening area is approximately fifty-five (55%) of the peripheral ring opening area;

(3) the total peripheral opening length is greater than approximately twenty percent (20%), thirty percent (30%), forty percent (40%), and fifty (50%) of the imaginary center line length;

(4) the total peripheral opening length is approximately fifty-five (55%) of the imaginary center line length;

(5) the total peripheral opening angular distance is greater than approximately seventy-five degrees (75°), one-hundred ten degrees (110°), one-hundred forty-five degrees) (145°), and one-hundred eighty degrees (180°); and/or (6) the total peripheral opening angular distance is approximately two hundred degrees (200°).

In exemplary embodiments, the shape of the body 12 includes:

(1) the upper portion 22 of the inner surface 18 of the body 12 being generally convex shaped; and/or (2) the middle portion 24 of the inner surface 18 of the body 12 being generally concave shaped.

In exemplary embodiments, the shape of the baffle 14 includes:

(1) the peripheral openings 34 in the baffle 14 being generally funnel shaped;

(2) the peripheral openings 34 in the baffle 14 being generally oblong shaped in a circumferential direction;

(3) the ridge 40 extending in a circumferential direction along the radially inner edge of the peripheral openings 34; and/or (4) the baffle 14 including the first portion 42 and the second portion 44, the first portion 42 and the second portion 44 being made from different materials, and/or the first portion 42 being made from a harder material than the second portion 44.

In exemplary embodiments, the disposal splash guard 10 directs at least ten percent (10%) of water flowing into the disposal splash guard 10 through the peripheral openings 34 in the baffle 14. In exemplary embodiments, the disposal splash guard 10 directs at least fifteen percent (15%) of water flowing into the disposal splash guard 10 through the peripheral openings 34 in the baffle 14. In exemplary embodiments, the disposal splash guard 10 directs at least twenty percent (20%) of water flowing into the disposal splash guard 10 through the peripheral openings 34 in the baffle 14. In exemplary embodiments, the disposal splash guard 10 directs at least twenty-five percent (25%) of water flowing into the disposal splash guard 10 through the peripheral openings 34 in the baffle 14. In exemplary embodiments, the disposal splash guard 10 directs at least thirty percent (30%) of water flowing into the disposal splash guard 10 through the peripheral openings 34 in the disposal splash guard 10. In determining the percent of water flowing into the disposal splash guard 10 that is directed through the peripheral openings 34 in the baffle 14, water from a faucet is directed into a sink, in which the disposal D is mounted, approximately two inches (2 in.) from an outer edge of the mounting flange F.

In the illustrated embodiment of FIGS. 1 and 2*a*-2*d*, the disposal splash guard 10A includes the body 12A and the baffle 14A.

In the illustrated embodiment of FIGS. 1 and 2*a*-2*d*, the body 12A is generally cylindrical shaped. In the illustrated embodiment of FIGS. 1 and 2*a*-2*d*, the body 12A includes the opening 16A. In the illustrated embodiment of FIGS. 1 and 2*a*-2*d*, the opening 16A is a generally central opening. In the illustrated embodiment of FIGS. 1 and 2*a*-2*d*, the body 12A includes the inner surface 18A and the outer surface 20A. In the illustrated embodiment of FIGS. 1 and 2*a*-2*d*, the inner surface 18A includes the upper portion 22A, the middle portion 24A, and the lower portion 26A. In the illustrated embodiment of FIGS. 1 and 2*a*-2*d*, the upper portion 22A of the inner surface 18A of the body 12A is generally convex shaped. In the illustrated embodiment of FIGS. 1 and 2*a*-2*d*, the middle portion 24A of the inner surface 18A of the body 12A is generally concave shaped.

In the illustrated embodiment of FIGS. 1 and 2*a*-2*d*, the baffle 14A extends inwardly from the lower portion 26A of the inner surface 18A of the body 12A across the opening 16A in the body 12A. In the illustrated embodiment of FIGS. 1 and 2*a*-2*d*, the baffle 14A includes the upper surface 28A and the lower surface 30A. In the illustrated embodiment of FIGS. 1 and 2*a*-2*d*, the baffle 14A includes the primary opening 32A. In the illustrated embodiment of FIGS. 1 and 2*a*-2*d*, the primary opening 32A extends from the upper surface 28A through the lower surface 30A of the baffle 14A. In the illustrated embodiment of FIGS. 1 and 2*a*-2*d*, the primary opening 32A is a generally central opening.

In the illustrated embodiment of FIGS. 1 and 2*a*-2*d*, the baffle 14A includes the plurality of peripheral openings 34A. In the illustrated embodiment of FIGS. 1 and 2*a*-2*d*, the peripheral openings 34A extend from the upper surface 28A through the lower surface 30A of the baffle 14A. In the illustrated embodiment of FIGS. 1 and 2*a*-2*d*, the peripheral openings 34A are generally spaced around a circumference of the baffle 14A. In the illustrated embodiment of FIGS. 1 and 2*a*-2*d*, the peripheral openings 34A are generally funnel shaped. In the illustrated embodiment of FIGS. 1 and 2*a*-2*d*, the peripheral openings 34A are generally oblong shaped in a circumferential direction.

In the illustrated embodiment of FIGS. 1 and 2*a*-2*d*, the baffle 14A includes the plurality of splits 36A. In the illustrated embodiment of FIGS. 1 and 2*a*-2*d*, the splits 36A extend between the primary opening 32A and one of the peripheral openings 34A in a radial direction. In the illustrated embodiment of FIGS. 1 and 2*a*-2*d*, the baffle 14A includes the plurality of flaps 38A. In the illustrated embodiment of FIGS. 1 and 2*a*-2*d*, the flaps 38A extend between the primary opening 32A and the peripheral openings 34A in a radial direction and between the splits 36A in a circumferential direction. In the illustrated embodiment of FIGS. 1 and 2*a*-2*d*, the splits 36A are slits.

In the illustrated embodiment of FIGS. 3*a*-3*e*, the disposal splash guard 10B includes the body 12B and the baffle 14B.

In the illustrated embodiment of FIGS. 3*a*-3*e*, the body 12B is generally cylindrical shaped. In the illustrated embodiment of FIGS. 3*a*-3*e*, the body 12B includes the opening 16B. In the illustrated embodiment of FIGS. 3*a*-3*e*, the opening 16B is a generally central opening. In the illustrated embodiment of FIGS. 3*a*-3*e*, the body 12B includes the inner surface 18B and the outer surface 20B. In the illustrated embodiment of FIGS. 3*a*-3*e*, the inner surface 18B includes the upper portion 22B, the middle portion 24B, and the lower portion 26B. In the illustrated embodiment of FIGS. 3*a*-3*e*, the upper portion 22B of the inner surface 18B of the body 12B is generally convex shaped. In the illustrated embodiment of FIGS. 3*a*-3*e*, the middle portion 24B of the inner surface 18B of the body 12B is generally concave shaped.

In the illustrated embodiment of FIGS. 3*a*-3*e*, the baffle 14B extends inwardly from the lower portion 26B of the inner surface 18B of the body 12B across the opening 16B in the body 12B. In the illustrated embodiment of FIGS. 3*a*-3*e*, the baffle 14B includes the upper surface 28B and the lower surface 30B. In the illustrated embodiment of FIGS. 3*a*-3*e*, the baffle 14B includes the primary opening 32B. In the illustrated embodiment of FIGS. 3*a*-3*e*, the primary opening 32B extends from the upper surface 28B through the lower surface 30B of the baffle 14B. In the illustrated embodiment of FIGS. 3*a*-3*e*, the primary opening 32B is a generally central opening.

In the illustrated embodiment of FIGS. 3*a*-3*e*, the baffle 14B includes the plurality of peripheral openings 34B. In the illustrated embodiment of FIGS. 3*a*-3*e*, the peripheral openings 34B extend from the upper surface 28B through the lower surface 30B of the baffle 14B. In the illustrated embodiment of FIGS. 3*a*-3*e*, the peripheral openings 34B are generally spaced around a circumference of the baffle 14B. In the illustrated embodiment of FIGS. 3*a*-3*e*, the peripheral openings 34B are generally funnel shaped. In the illustrated embodiment of FIGS. 3*a*-3*e*, the peripheral openings 34B are generally oblong shaped in a circumferential direction.

In the illustrated embodiment of FIGS. 3*a*-3*e*, the baffle 14B includes the plurality of splits 36B. In the illustrated embodiment of FIGS. 3*a*-3*e*, the splits 36B extend between the primary opening 32B and one of the peripheral openings 34B in a radial direction. In the illustrated embodiment of FIGS. 3*a*-3*e*, the baffle 14B includes the plurality of flaps 38B. In the illustrated embodiment of FIGS. 3*a*-3*e*, the flaps 38B extend between the primary opening 32B and the peripheral openings 34B in a radial direction and between the splits 36B in a circumferential direction. In the illustrated embodiment of FIGS. 3*a*-3*e*, the splits 36B are webs.

In the illustrated embodiment of FIGS. 4*a*-4*d*, the disposal splash guard 10C includes the body 12C and the baffle 14C.

In the illustrated embodiment of FIGS. 4*a*-4*d*, the body 12C is generally cylindrical shaped. In the illustrated embodiment of FIGS. 4*a*-4*d*, the body 12C includes the opening 16C. In the illustrated embodiment of FIGS. 4*a*-4*d*, the opening 16C is a generally central opening. In the illustrated embodiment of FIGS. 4*a*-4*d*, the body 12C includes the inner surface 18C and the outer surface 20C. In the illustrated embodiment of FIGS. 4*a*-4*d*, the inner surface 18C includes the upper portion 22C, the middle portion 24C, and the lower portion 26C. In the illustrated embodiment of FIGS. 4*a*-4*d*, the upper portion 22C and the middle portion 24C of the inner surface 18C of the body 12C are generally straight. In the illustrated embodiment of FIGS. 4*a*-4*d*, the inner surface 18C of the body 12C generally angles inwardly from the upper portion 22C to the middle portion 24C.

In the illustrated embodiment of FIGS. 4*a*-4*d*, the baffle 14C extends inwardly from the lower portion 26C of the inner surface 18C of the body 12C across the opening 16C in the body 12C. In the illustrated embodiment of FIGS. 4*a*-4*d*, the baffle 14C includes the upper surface 28C and the lower surface 30C. In the illustrated embodiment of FIGS. 4*a*-4*d*, the baffle 14C includes the primary opening 32C. In the illustrated embodiment of FIGS. 4*a*-4*d*, the primary opening 32C extends from the upper surface 28C through the lower surface 30C of the baffle 14C. In the illustrated embodiment of FIGS. 4*a*-4*d*, the primary opening 32C is a generally central opening.

In the illustrated embodiment of FIGS. 4*a*-4*d*, the baffle 14C includes the plurality of peripheral openings 34C. In the illustrated embodiment of FIGS. 4*a*-4*d*, the peripheral openings 34C extend from the upper surface 28C through the lower surface 30C of the baffle 14C. In the illustrated embodiment of FIGS. 4*a*-4*d*, the peripheral openings 34C are generally spaced around a circumference of the baffle 14C. In the illustrated embodiment of FIGS. 4*a*-4*d*, the peripheral openings 34C are generally funnel shaped. In the illustrated embodiment of FIGS. 4*a*-4*d*, the peripheral openings 34C are generally oblong shaped in a circumferential direction.

In the illustrated embodiment of FIGS. 4*a*-4*d*, the baffle 14C includes the ridge 40C. In the illustrated embodiment of FIGS. 4*a*-4*d*, the ridge 40C extends in a circumferential direction radially inward of the peripheral openings 34C. In the illustrated embodiment of FIGS. 4*a*-4*d*, the ridge 40C is continuous. However, one of ordinary skill in the art will appreciate that the ridge 40C could be non-continuous. In an exemplary embodiment in which the ridge 40C is non-continuous, the ridge 40C generally extends along radial outer edges of the splits 36C, but generally does not extend along radial outer edges of the flaps 38C.

In the illustrated embodiment of FIGS. 4*a*-4*d*, the baffle 14C includes the plurality of splits 36C. In the illustrated embodiment of FIGS. 4*a*-4*d*, the splits 36C extend between the primary opening 32C and one of the peripheral openings 34C in a radial direction. In the illustrated embodiment of FIGS. 4*a*-4*d*, the baffle 14C includes the plurality of flaps 38C. In the illustrated embodiment of FIGS. 4*a*-4*d*, the flaps 38C extend between the primary opening 32C and the peripheral openings 34C in a radial direction and between the splits 36C in a circumferential direction. In the illustrated embodiment of FIGS. 4*a*-4*d*, the splits 36C are webs.

In the illustrated embodiment of FIGS. 5*a*-5*d*, the disposal splash guard 10D includes the body 12D and the baffle 14D.

In the illustrated embodiment of FIGS. 5*a*-5*d*, the body 12D is generally cylindrical shaped. In the illustrated embodiment of FIGS. 5*a*-5*d*, the body 12D includes the opening 16D. In the illustrated embodiment of FIGS. 5*a*-5*d*, the opening 16D is a generally central opening. In the illustrated embodiment of FIGS. 5*a*-5*d*, the body 12D includes the inner surface 18D and the outer surface 20D. In the illustrated embodiment of FIGS. 5*a*-5*d*, the inner surface 18D includes the upper portion 22D, the middle portion 24D, and the lower portion 26D. In the illustrated embodiment of FIGS. 5*a*-5*d*, the upper portion 22D and the middle portion 24D of the inner surface 18D of the body 12D are generally straight. In the illustrated embodiment of FIGS. 5*a*-5*d*, the inner surface 18D of the body 12D generally angles inwardly from the upper portion 22D to the middle portion 24D.

In the illustrated embodiment of FIGS. 5*a*-5*d*, the baffle 14D extends inwardly from the lower portion 26D of the inner surface 18D of the body 12D across the opening 16D in the body 12D. In the illustrated embodiment of FIGS. 5*a*-5*d*, the baffle 14D includes the upper surface 28D and the lower surface 30D. In the illustrated embodiment of FIGS. 5*a*-5*d*, the baffle 14D includes the primary opening 32D. In the illustrated embodiment of FIGS. 5*a*-5*d*, the primary opening 32D extends from the upper surface 28D through the lower surface 30D of the baffle 14D. In the illustrated embodiment of FIGS. 5*a*-5*d*, the primary opening 32D is a generally central opening.

In the illustrated embodiment of FIGS. 5*a*-5*d*, the baffle 14D includes the plurality of peripheral openings 34D. In the illustrated embodiment of FIGS. 5*a*-5*d*, the peripheral openings 34D extend from the upper surface 28D through the lower surface 30D of the baffle 14D. In the illustrated embodiment of FIGS. 5*a*-5*d*, the peripheral openings 34D are generally spaced around a circumference of the baffle 14D. In the illustrated embodiment of FIGS. 5*a*-5*d*, the peripheral openings 34D are generally funnel shaped. In the illustrated embodiment of FIGS. 5*a*-5*d*, the peripheral openings 34D are generally oblong shaped in a circumferential direction.

In the illustrated embodiment of FIGS. 5*a*-5*d*, the baffle 14D includes the plurality of splits 36D. In the illustrated embodiment of FIGS. 5*a*-5*d*, the splits 36D extend between the primary opening 32D and one of the peripheral openings 34D in a radial direction. In the illustrated embodiment of FIGS. 5*a*-5*d*, the baffle 14D includes the plurality of flaps 38D. In the illustrated embodiment of FIGS. 5*a*-5*d*, the flaps 38D extend between the primary opening 32D and the peripheral openings 34D in a radial direction and between the splits 36D in a circumferential direction. In the illustrated embodiment of FIGS. 5*a*-5*d*, the splits 36D are webs.

In the illustrated embodiment of FIGS. 5*a*-5*d*, the baffle 14D includes a first portion 42D and a second portion 44D. In the illustrated embodiment of FIGS. 5*a*-5*d*, the first portion 42D includes the plurality of peripheral openings 34D. In the illustrated embodiment of FIGS. 5*a*-5*d*, the second portion 44D includes the primary opening 32D, the plurality of splits 36D, and the plurality of flaps 38D. In an exemplary embodiment, the first portion 42D and the second portion 44D are made from different materials. In an exemplary embodiment, the first portion 42D is made from a harder material than the second portion 44D. Although the baffle 14D has been described as including a first portion 42D and a second portion 44D, one of ordinary skill in the art will appreciate that the baffle 14D could include more than two portions. Additionally, in exemplary embodiments in which the baffle 14D includes multiple portions, each portion of the baffle 14D could be made from different materials.

In an exemplary embodiment, the disposal splash guard 10 is made from an elastomer. Exemplary elastomers include thermoplastic elastomer ("TPE"), acrylonitrile butadiene rubber ("NBR"), and silicone. In an exemplary embodiment in which the first portion 42 and the second portion 44 are made from different materials, the first portion 42 is made from a polymer, and the second portion 44 is made from an elastomer. Exemplary polymers include polypropylene, acrylonitrile-butadiene-styrene ("ABS"), polystyrene, and polyoxymethylene. As stated above, exemplary elastomers include thermoplastic elastomer ("TPE"), acrylonitrile butadiene rubber ("NBR"), and silicone.

One of ordinary skill in the art will now appreciate that the present invention provides a disposal splash guard that enables water flowing into the disposal splash guard to be directed through peripheral openings in the disposal splash guard. Although the present invention has been shown and described with reference to particular embodiments, equivalent alterations and modifications will occur to those skilled in the art upon reading and understanding this specification. The present invention includes all such equivalent alterations and modifications and is limited only by the scope of the following claims in light of their full scope of equivalents.

What is claimed is:

1. A disposal splash guard, comprising:

a body, the body being generally cylindrical shaped, the body including an inner surface and an outer surface; and a baffle, the baffle extending inwardly from the inner surface of the body, the baffle including an upper surface and a lower surface, the baffle including a primary opening and a plurality of peripheral openings extending from the upper surface through the lower surface, the baffle including a plurality of splits and a plurality of flaps;

wherein a size of the peripheral openings is operable to direct water flowing into the disposal splash guard through the peripheral openings in the baffle.

2. The disposal splash guard of claim 1, wherein a total peripheral opening area is greater than approximately twenty percent of a peripheral ring opening area.

3. The disposal splash guard of claim 1, wherein a total peripheral opening area is approximately fifty-five percent of a peripheral ring opening area.

4. The disposal splash guard of claim 1, wherein a total peripheral opening length is greater than approximately twenty percent of an imaginary center line length.

5. The disposal splash guard of claim 1, wherein a total peripheral opening length is approximately fifty-five percent of an imaginary center line length.

6. The disposal splash guard of claim 1, wherein a total peripheral opening angular distance is greater than approximately seventy-five degrees.

7. The disposal splash guard of claim 1, wherein a total peripheral opening angular distance is approximately two hundred degrees.

8. A disposal splash guard, comprising:

a body, the body being generally cylindrical shaped, the body including an inner surface and an outer surface; and a baffle, the baffle extending inwardly from the inner surface of the body, the baffle including an upper surface and a lower surface, the baffle including a primary opening and a plurality of peripheral openings extending from the upper surface through the lower surface, the baffle including a plurality of splits and a plurality of flaps;

wherein at least one of a shape of the body and a shape of the baffle is operable to direct water flowing into the disposal splash guard through the peripheral openings in the baffle.

9. The disposal splash guard of claim 8, wherein an upper portion of the inner surface of the body is generally convex shaped.

10. The disposal splash guard of claim 8, wherein a middle portion of the inner surface of the body is generally concave shaped.

11. The disposal splash guard of claim 8, wherein the peripheral openings are generally funnel shaped.

12. The disposal splash guard of claim 8, wherein the peripheral openings are generally oblong shaped in a circumferential direction.

13. The disposal splash guard of claim 8, wherein the baffle includes a ridge extending at least partially around the baffle in a circumferential direction radially inwardly of the peripheral openings.

14. The disposal splash guard of claim 8, wherein the baffle includes a first portion and a second portion, and the first portion is made from a harder material than the second portion.

15. A disposal splash guard, comprising:

a body, the body being generally cylindrical shaped, the body including an inner surface and an outer surface; and a baffle, the baffle extending inwardly from the inner surface of the body, the baffle including an upper surface and a lower surface, the baffle including a primary opening and a plurality of peripheral openings extending from the upper surface through the lower surface, the baffle including a plurality of splits and a plurality of flaps;

wherein at least one of a size of the peripheral openings, a shape of the body, and a shape of the baffle is operable to direct at least ten percent of water flowing into the disposal splash guard through the peripheral openings in the baffle.

16. The disposal splash guard of claim 15, wherein at least one of the size of the peripheral openings, the shape of the body, and the shape of the baffle is operable to direct at least twenty-five percent of water flowing into the disposal splash guard through the peripheral openings in the baffle.

17. The disposal splash guard of claim 15, wherein at least one of a total peripheral opening area is greater than approximately twenty percent of a peripheral ring opening area, a total peripheral opening length is greater than approximately twenty percent of an imaginary center line length, and a total peripheral opening angular distance is greater than approximately seventy-five degrees.

18. The disposal splash guard of claim 15, wherein at least one of a total peripheral opening area is approximately fifty-five percent of a peripheral ring opening area, a total peripheral opening length is approximately fifty-five percent of an imaginary center line length, and a total peripheral opening angular distance is approximately two hundred degrees.

19. The disposal splash guard of claim 15, wherein at least one of an upper portion of the inner surface of the body is generally convex shaped and a middle portion of the inner surface of the body is generally concave shaped.

20. The disposal splash guard of claim 15, wherein at least one of the peripheral openings are generally funnel shaped, the peripheral openings are generally oblong shaped in a circumferential direction, the baffle includes a ridge extending at least partially around the baffle in a circumferential direction radially inwardly of the peripheral openings, and the baffle includes a first portion and a second portion, and the first portion is made from a harder material than the second portion.

* * * * *